United States Patent [19]

Shaw

[11] Patent Number: 4,788,805

[45] Date of Patent: Dec. 6, 1988

[54] COVER FOR WALL MOUNTED AIR CONDITIONER

[76] Inventor: Daniel M. Shaw, 217 S. Hamilton St., P.O. Box 1072, Madison, Wis. 53701

[21] Appl. No.: 600,609

[22] Filed: Apr. 18, 1984

Related U.S. Application Data

[63] Continuation of Ser. No. 280,905, Jul. 6, 1981, abandoned.

[51] Int. Cl.[4] ..... E06B 3/30

[52] U.S. Cl. ..... 52/202; 52/403; 52/716

[58] Field of Search ..... 52/202, 403, 716

[56] References Cited

U.S. PATENT DOCUMENTS

| | | | |
|---|---|---|---|
| 3,002,236 | 10/1961 | Humphner | 52/202 |
| 3,214,879 | 11/1965 | Ellingson, Jr. | 52/202 |
| 4,050,608 | 9/1977 | Smith | 52/403 |
| 4,069,641 | 1/1978 | Dezutter | 52/202 |
| 4,134,240 | 1/1979 | Bologna et al. | 52/202 |
| 4,193,232 | 3/1980 | Alstead et al. | 52/202 |
| 4,215,517 | 8/1980 | Everson | 52/202 |
| 4,341,048 | 7/1982 | Minter | 52/716 |
| 4,387,541 | 6/1983 | Boomershine | 52/202 |
| 4,407,099 | 10/1983 | McLaughlin | 52/202 |

*Primary Examiner*—Michael Safavi

*Attorney, Agent, or Firm*—Lathrop & Clark

[57] ABSTRACT

A cover (10) for an air conditioner (29) mounted in the wall (11) of a building. The cover (10) has a back panel (13), four side wall panels (14, 15, 16, 17) which extend from the back panel, a flange (20) which extends around the periphery and is formed integrally with the side walls, and a sealing strip (30) of compressible weatherstripping material which is adhered to the inner surface of the flange in position to seal against the wall around the periphery of the air conditioner. Retainers (22) are secured to the wall adjacent the flange (20) and are adapted to engage the flange and thereby press the sealing strips (30) tightly against the wall. A modified cover (40) has a short top side wall (43) with a clip connection strip (53) having weatherstripping (54) thereon to seal up against the face of the window frame where the air conditioner is mounted immediately beneath a window. The cover (10, 40) seals off any drafts coming through the air conditioner or the spaces around the air conditioner and is adapted for quick attachment and removal.

12 Claims, 3 Drawing Sheets

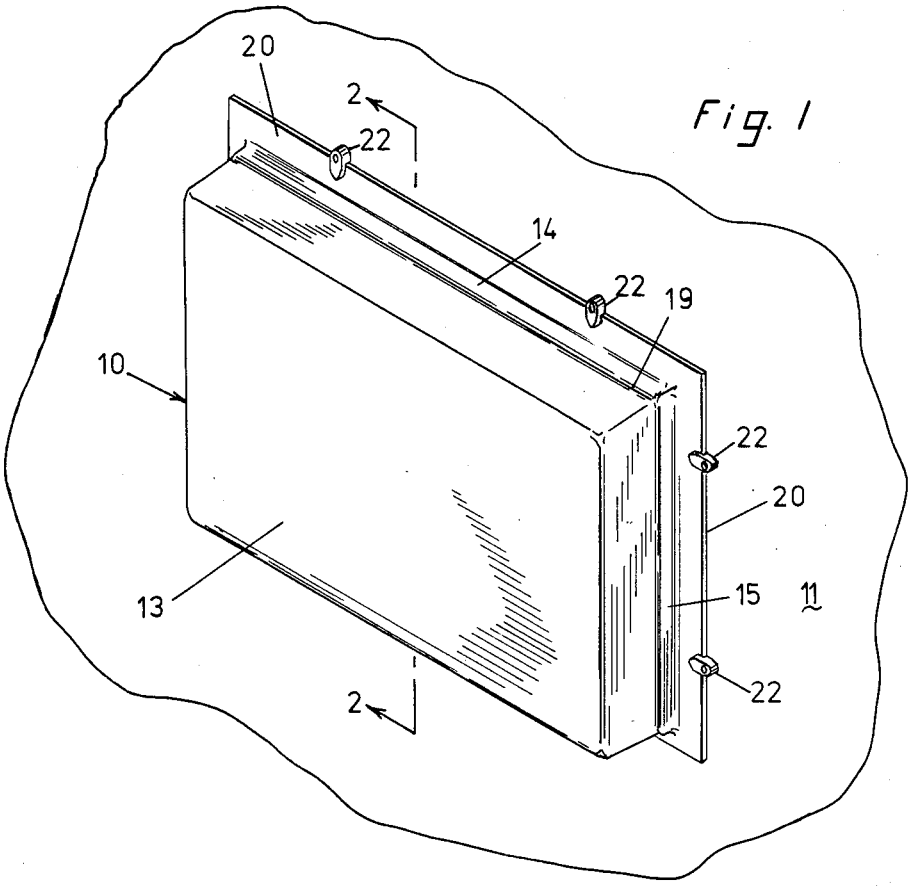
Fig. 1
Fig. 2
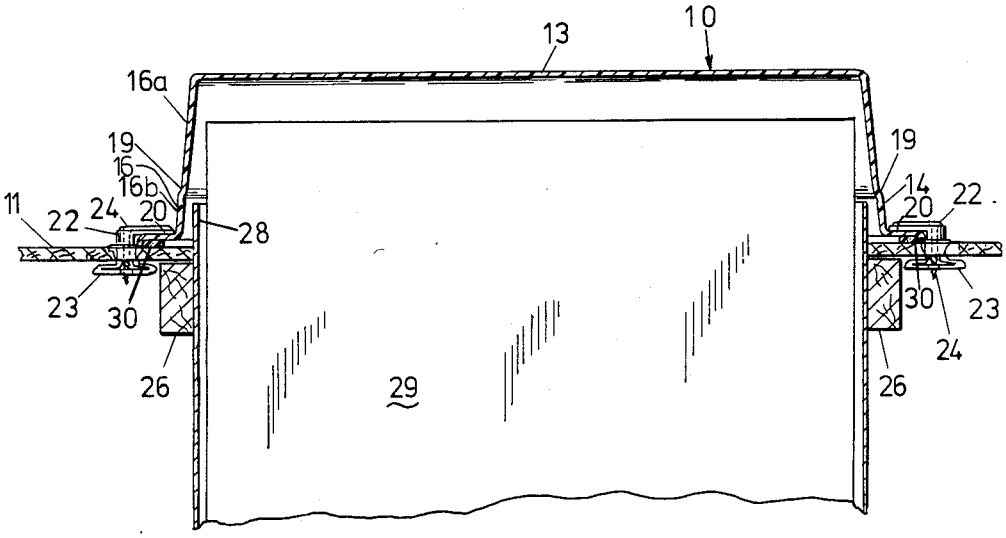

Fig. 3
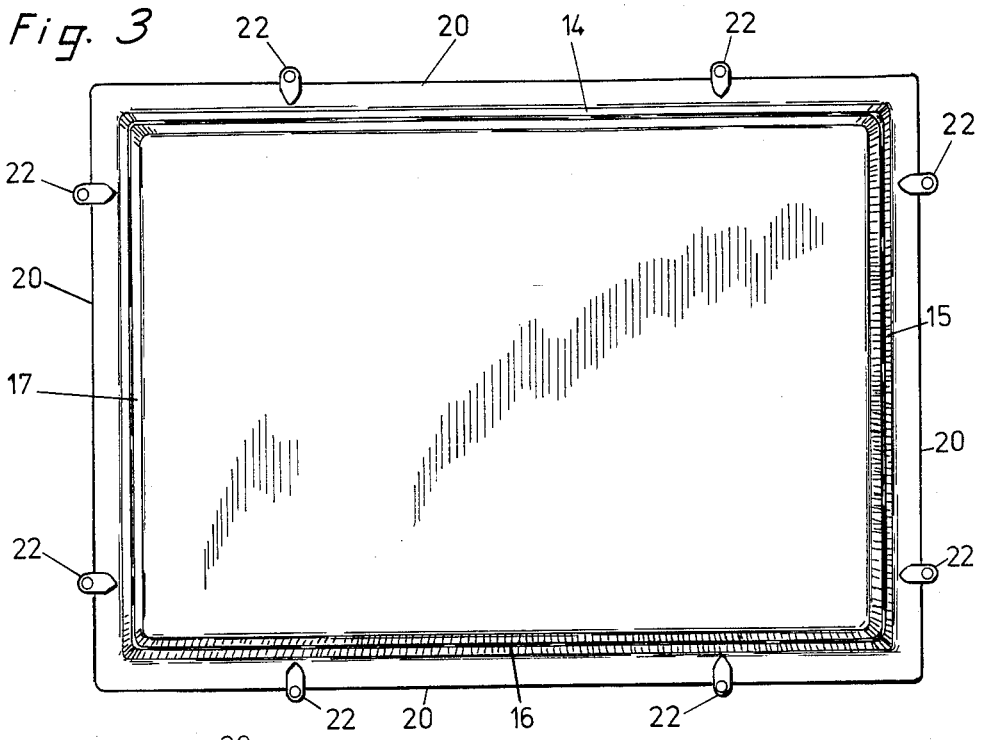
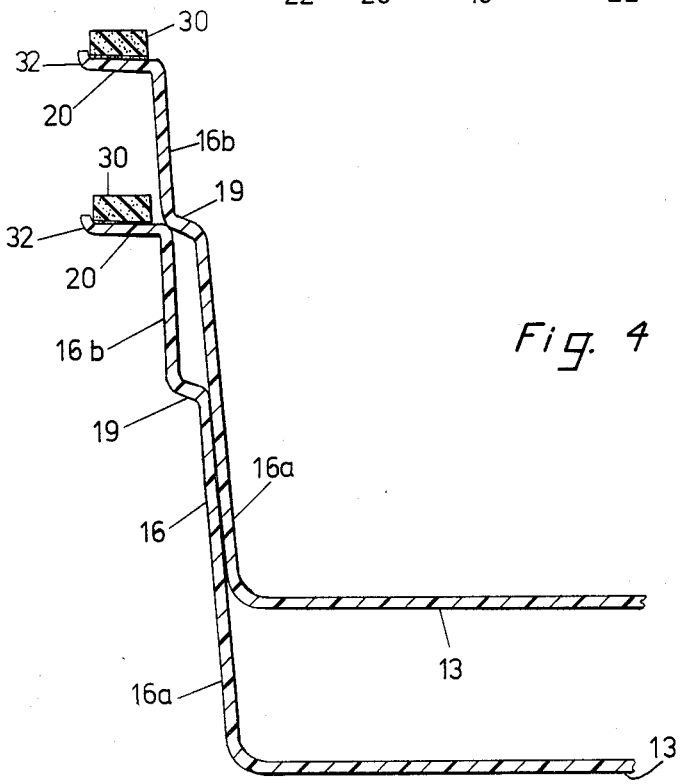
Fig. 4

Fig. 5
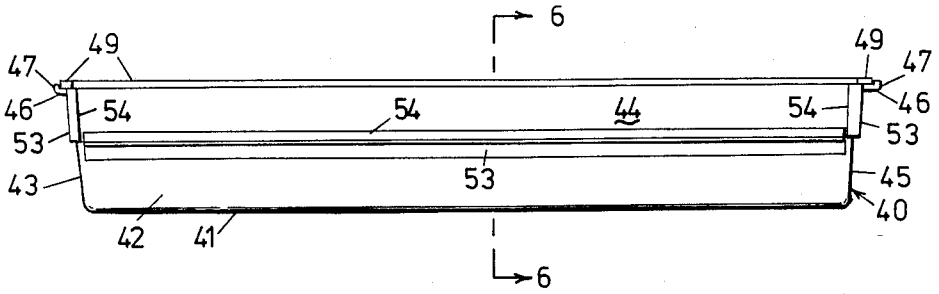
Fig. 6
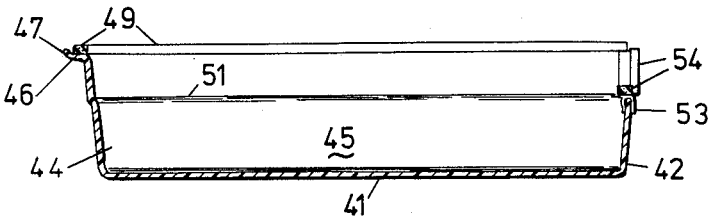
Fig. 8
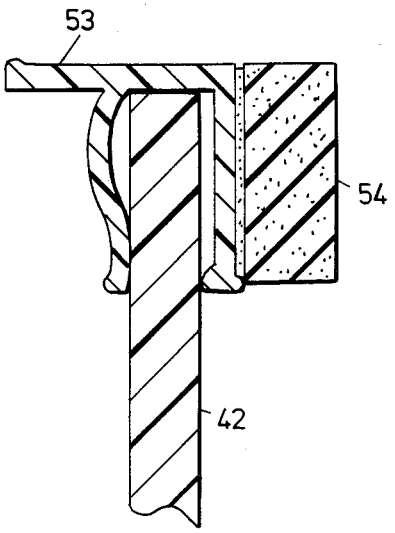
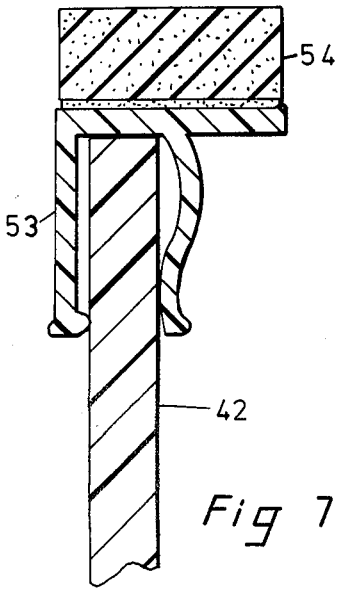
Fig 7

COVER FOR WALL MOUNTED AIR CONDITIONER

This application is a continuation, of application Ser. No. 280,905, filed July 6, 1981 now abandoned.

TECHNICAL FIELD

This invention pertains generally to the field of accessories used with air conditioning equipment and particularly to products which cover or seal air conditioning units.

BACKGROUND ART

Room air conditioning units are often mounted in openings in the outer walls of buildings and are left in place throughout the year. Such through the wall units must be mounted so that they can be replaced when necessary; in a typical installation, the unit rests within a metal sleeve or frame mounted around the wall opening, with the sleeve usually extending an inch or two from the wall into the interior of the room. An air conditioning unit can be replaced by simply sliding it out of the metal sleeve and sliding a new unit in place. Where an air conditioning unit is not desired by the occupant of the apartment, the wall opening can be closed off, typically by fitting a box-like metal cap over the ends of the sleeve on the interior and exterior sides of the wall.

In colder climates, the through the wall air conditioning units can be a major source of heat loss from a building during the winter months. The air conditioner unit itself is not air tight and can allow cold outside air to pass through into the room interior. In addition, since the air conditioner sits loosely within the sleeve which surrounds it, cold air can blow through the areas between the sleeve and the air conditioner, and sometimes between the sleeve and the adjacent wall structure, resulting in a substantial heat loss from the apartment. Weatherstripping placed between the air conditioner and the sleeve can be helpful but does not totally eliminate seepage of cold air into the room between the sleeve and the air conditioner, and does nothing to prevent heat loss through the air conditioner itself. This heat loss has prompted apartment dwellers to attempt to cover the air conditioner with plastic sheet material or blankets, remedies which are both unsightly and largely ineffective. With rising energy costs, the lost heat due to the air conditioner openings requires attention on the part of landlords, but the only reasonably effective solution has been to remove the air conditioner each fall and to fill and cover the wall opening--operations which are time consuming and expensive. Air leaks still occur even about the openings that have been filled and capped because there are often cracks between the sleeve and the wall and because the seal between the cap and the sleeve is generally not air-tight.

DISCLOSURE OF THE INVENTION

The air conditioner cover of the present invention is adapted to be readily installed and removed from a position sealing the interior end of a wall air conditioner. The unit is designed so that it can be initially assembled and mounted in a few minutes, and can thereafter be removed and reinstalled in a few seconds. After initial installation, the air conditioner cover is removably held in place by retainers which are permanently attached to the wall of the room at positions around the opening in which the air conditioner is mounted.

The body of the cover is preferably integrally formed and molded out of one piece of high impact polystyrene. The cover body includes a flat, rectangular back panel which is selected to be about the same size as the inner face of the air conditioner which is being covered. Top, bottom and end side walls are formed integrally with the back panel and extend outwardly from the four edges of the back panel at a slight flared angle. A curved joint section extends around the periphery of the four joined side walls to divide each of the side walls into first and second sections. The joint section curves slightly outwardly from each of the four first side wall sections and then downwardly into the second side wall sections. An outwardly extending flange, formed integrally with the side walls, extends around the entire periphery of the side walls in a plane substantially parallel to the back panel. A lip, comprising a short inwardly curved section, is integrally formed on the outer edge of the flange. The lip rigidifies and strengthens the flange area and also cooperates with weatherstripping material which is secured to the inner side of the periphery of the flange just adjacent to the lip on the flange.

Installation is accomplished by placing the cover over the portion of the air conditioner that sticks out into the room such that the weatherstripping material rests against the wall surrounding the air conditioner. Several retainers are mounted to the wall at various positions about the periphery of the flange and are adapted to engage the cover to hold it on the wall. Each retainer preferably has a cantilevered portion extending out from the retainer base at a position spaced away from the wall The retainer can be turned so that the cantilevered portion engages the outer surface of the adjacent flange and urges the flange inwardly toward the wall to compress the weather stripping. This results in a tight seal around the entire periphery of the cover, preventing cold air from leaking through the air conditioner, through the openings between the air conditioner and the sleeve, or through cracks in openings between the sleeve and the wall structure itself The side walls of the cover are preferably flared out as indicated to accommodate nestable stacking of the covers, thereby providing a compact package for shipment and storage. The curved joint section between the first and second side wall sections allows the covers to fit together without jamming, so that they may be more easily unstacked. The joint section also increases the rigidity of the side walls and strengthens the cover structure.

The air conditioner cover may be modified to adapt to those situations where the air conditioner extends directly underneath a window so that the top edge of the air conditioner abuts a portion of the window frame or sill. In this situation, a flange extending out from the top side wall would interfere with placement of the cover. Thus, the modified cover has a top side wall which is shorter than the other three side walls so that an indentation or gap is defined between the top edges of the two end side walls and the inner edge of the top side wall. This indentation is sized to accommodate a window frame which extends out from the wall into the room. A plastic clip connection strip having weatherstripping material secured to one surface is fitted over the protruding edge of the top side wall, and similar strips, shorter in length, fit over the protruding edges of the two end side walls. The weatherstripping along these edges engages the bottom and/or sides of the window frame to complete the seal about the air conditioner.

Further objects, features and advantages of the invention will be apparent from the following detailed description taken in conjunction with the accompanying drawings showing preferred embodiments of the invention.

BRIEF DESCRIPTION OF THE DRAWINGS

In the drawings

FIG. 1 is a perspective view illustrating the air conditioner cover of the invention mounted on an interior wall.

FIG. 2 is a cross-sectional view of the cover of FIG. 1 taken along the lines 2—2 of FIG. 1.

FIG. 3 is a top plan view of the air conditioner cover of FIG. 1.

FIG. 4 is a cross-sectional view showing the side walls of two covers placed in stacked relation.

FIG. 5 is a top side elevation view of another embodiment of the cover in accordance with the invention.

FIG. 6 is a cross-sectional view of the cover of FIG. 5 taken along the lines 6—6 of FIG. 5.

FIG. 7 is a cross-sectional view of a connection strip utilized in the cover of FIG. 5.

FIG. 8 is a cross-sectional view of a modified connection strip utilized in the cover of FIG. 5.

BEST MODE FOR CARRYING OUT THE INVENTION

With reference to the drawings, an air conditioner cover in accordance with the invention is shown generally at 10 in FIG. 1 mounted illustratively on the inside wall 11 of a building such as an apartment or a home. The cover 10 has a one piece cover body including a generally rectangular back panel 13 which is sized and shaped to approximately conform to the face of the air conditioner being covered. For standard sized room air conditioners, a back panel having dimensions of approximately 18 inches on its short side and 26 inches on its long side has been found satisfactory. Extending inwardly, toward the wall 11, from the four edges of the back panel 13 are four side walls 14, 15, 16 and 17; the top side wall 14 and bottom side wall 16 extending along the long sides of the back panel 13 and the end side walls 15 and 17 extending along the short sides of the back panel, as best shown in FIG. 3. The four side walls 14–17 are formed integrally with the back panel 13, flare away from the back panel at a slight outward angle, and are integrally connected together to form a continuous side wall around the back panel.

Each of the side walls is divided into first and second side wall sections by a curved joint section 19, which extends entirely around the periphery of the side walls parallel to the back panel. The joint section 19 curves outwardly from the first section of each side wall and downwardly to the second section of each side wall, so that the second section of each side wall is spaced slightly outwardly of the first side wall section, as illustrated in the cross-sectional view of FIG. 2 showing the first section **16*a* and second section 16*b* of the bottom side wall 16. As explained further below, the prime purpose of the joint section 19** is to facilitate the stacking and unstacking of several covers for shipping or storage.

A flange 20 extends outwardly from the bottom of the side walls 14, 15, 16 and 17 and lies in a plane substantially parallel to that of the back panel 13. The flange 20 has flat outer and inner surfaces approximately three-quarters half inch wide. The flange provides additional structural rigidity to the cover and also provides a surface which can be engaged by rotatable retainers 22 which are mounted on the wall 11 around the periphery of the cover. The retainers preferably have a base portion and a cantilevered portion extending from the base at a position spaced away from the wall. As shown in the cross-sectional view of FIG. 2, the retainers 22 can be attached to the plasterboard wall 11 by any suitable wall connectors such as a plastic expansion clamps 23, to which the retainers 22 are connected by a screw 24. The flanges 20 preferably extend outwardly just beyond the stud 26 which typically surrounds the wall opening so that the clamps 23 can be passed through the plasterboard wall 11, although the clamps shown and many other types of suitable fasteners can be anchored in the stud where necessary.

An illustrative mounting arrangement having two retainers along each side is shown in FIG. 3. Other suitable arrangements include two retainers along the top and bottom only, or a single retainer along each side. Non-rotating, offset clips may be mounted along one side such that the flange along that side slips under the clip, whereas rotating retainers are mounted on the opposite side of the cover.

With further reference to the cross-sectional view of FIG. 2, a metal sleeve 28 fits within the wall opening just inside of the studs 26, and the air conditioner unit 29 slides into place within the sleeve 28. The sleeve extends from the wall 11 for an inch or two, and the air conditioner 29 extends outwardly into the room usually another two inches beyond the sleeve, so that the height of the side walls 14–17 generally must be at least four to five inches. There will be inevitable gaps between the sleeve 28 and the air conditioner 29, allowing cold air and moisture to leak into the house, and allowing warm air to leak out; and the air conditioner unit 29 itself will often not be completely sealed to prevent passage of air therethrough, thereby contributing to the loss of heat from the house. The cover 10 seals off the air conditioner from the room by providing a weather tight seal around the air conditioner of weather-stripping material 30 which is attached to the inside surface of the flange 20. As shown in FIG. 2, when the retainers 22 are turned so their cantilevered portions engage the top surface of the flange 20, they compress the weather-stripping material 30 downwardly to form an air tight seal. The material 30 is preferably open cell foam rubber or plastic, in contrast to closed cell foam, to allow the material to more readily compress under the pressure of the retainers 22.

As best shown in the view of FIG. 4, a lip 32 is formed on the outer edge of the flange 20 and extends upwardly from the flange for approximately one-sixteenth inch. The lip 32 presents a more finished and smooth appearance to the observer in the room, and also serves to stiffen and reinforce the flange against the pressure that is applied by the retainers 22 so that the flange does not substantially bend where it is pressed upon by the retainers; if such bending occurred, the areas of the flange between the retainers would bulge up and diminish the effectiveness of the seal.

As illustrated in FIG. 4, two or more of the cover bodies of the covers 10 can be stacked one inside the other to minimize the space taken up by several covers during shipping or storage. The curved joint section 19 of a second cover placed within a first cover will engage the first cover at the corner connection between the side walls (bottom side wall 16 shown) and the flange 20 of the first cover. A side wall structure having the joint section 19 is preferred to a straight flared side wall for stacking purposes, since straight side walls would tend to tightly engage one another so that it might be difficult to remove the covers from the stack once they are packed tightly together. It is further preferred, as shown in FIG. 4, that the first section of each side wall, such as the side wall section **16*a*, extends inwardly from the back panel 13 at a slight flare angle to a perpendicular to the back panel (e.g., 5°), and that the second section of each side wall, such as the side wall section 16*b*, also extends inwardly from the joint section 19 at a flare angle which is less than the angle at which the first side wall section 16*a* is disposed (e.g., the side wall section 16*b* may make an angle of 2° with respect to a perpendicular to the plane of the back panel 13). By offsetting the angles of the upper and lower sections of the side walls, the corner at which the flange 20 meets the side wall will engage the joint section 19** of the next higher cover to support the cover in this position.

A modified embodiment of the cover which is particularly adapted for emplacement over air conditioners mounted under windows is shown generally at 40 in FIG. 5. The cover 40 is substantially similar to the cover 10, having a one piece cover body including a back panel 41, a top side wall 42, a short end side wall 43, a long bottom side wall 44, and another short end side wall 45. The side walls 43, 44 and 45 are identical to the side walls described above with respect to the cover 11, and a flange 46 is formed integrally with the three side walls and extends outwardly therefrom, with a lip 47 being formed on the outer edge of the flange. Sealing strips 49, preferably of open celled foam plastic, are adhered to the inner side of the flange 46 just inside the lip 47. Each of the side walls 43, 44 and 45 is divided by a curved joint section 51 into first and second sections. The construction, materials, and dimensions of the side wall sections 43, 44, 45, the joint section 51, the flange 46, the lip 47 and the sealing strips 49, are preferably as described above for the corresponding structural portions of the cover 10.

However, the top side wall 42 is shorter than any of the other side walls 43–45 and terminates in a straight inner edge spaced below the height of the flange 46. The distance between the height of the inner edge of the top side wall 42 and the height of the flanges 46 depends upon the distance which the window frame, against which the cover will abut, sticks out from the wall into the room. Thus, the modified embodiment 40 of the cover may be formed to the required dimensions at the time of production or may be cut from the cover 10 by the user to yield a cover having a top wall 42 of the proper height to fit a particular window frame.

In order to provide a tight seal between the edges of the short top wall 42 and the top edges of the end side walls 43 and 45, these edges have a plastic clip connection strip 53 mounted thereon. The connection strips 53 carry weatherstripping material 54, such as the foamed rubber or plastic described above for the strips 49, on the particular surface of each connection strip that will be abutting the window frame or adjacent portions of the wall. Detailed views of the plastic connection strips with associated weatherstripping are shown in FIGS. 7 and 8. The strip shown in FIG. 7 is a commercially available type of plastic attachment strip and has opposed leg strips which can clip over and be held onto the exposed portion of a wall, such as the side wall 42 shown in FIG. 7. In FIG. 7, the weatherstripping material 54 is adhered to the top shoulder surface of the connection strip 53, which is the positioning of the weatherstripping on the connection strips 53 which is shown in the views of FIGS. 5 and 6. In this position the weatherstripping would be adapted to press against the front of the window frame, whereas the positioning of the weatherstripping on the strip 53 as shown in FIG. 8, wherein the weatherstripping is adhered to a leg of the connection strip, would allow the weatherstripping to seal up against the bottom of a window frame. It may also be noted that, for certain installations where the air conditioner is directly beneath the window, only the flange extending from the side wall 42 will be removed, so that the side wall 42 will be substantially the same height as the other side walls. In this case, a connection strip 53 may be attached to the straight inner edge of the top side wall 42 in position to have the weatherstripping 54 seal against either any exposed space on the wall or against the bottom or sides of the window frame.

It is understood that the covers 10 and 40 may be provided in the form of a kit wherein the various components are assembled by the user to provide a cover emplaced properly over the air conditioner in the wall. For the cover 10, the kit includes the one piece cover body comprising the back panel 13, side walls 14–17, and the flange 20 with the lip 32 thereon. In addition, a plurality of rotatable retainers 22 are provided as well as a corresponding number of wall expansion clamps 23 and the screws 24 which connect the retainers 22 to the expansion clamps 23. Adhesive backed weatherstripping, sufficient in length to cover the inner surface of the flange, is also provided in the kit. To assemble the kit, the user cuts the weather- stripping material to size to fit each of the inner surfaces of the four side portions of the flange 20, peels the paper backing off of the pressure sensitive adhesive on the weatherstripping material and secures it to the inner surface of the flange, places the cover over the air conditioner in the proper desired position, marks the position where the retainers 22 should go to hold the cover in place, drills holes in the wall to accommodate the expansion clamps 23, inserts the clamps, and then inserts the screws 24 through the screw holes in the retainers 22 and into the clamps 23 to secure the retainers to the wall. The retainers 22 are then turned so that their cantilevered portions are not directed inwardly toward the position where the cover will be placed, and the cover is then fitted to its proper position over the extending air conditioner and the retainers 22 are turned back to have the cantilevered portions thereof engage the top surface of the flange 20 and press the cover tightly against the wall.

Similarly, the kit for the cover 40 consists of the one piece cover body comprising the back wall 41, side walls 42–45, and the flange 46 with the lip 47 thereon. It also includes a retainer 22, wall clamp 23 and screw 24 for each of the three sides of the cover body which have the flange 46 thereon Also included is a strip of foam weatherstripping material having adhesive backing thereon, and a length 53 of the plastic retainer strip clip member sufficient to cover the exposed straight edges of the top wall 42 and the adjacent exposed edges of the side walls 43 and 45. The user can cut down the size of the top side wall 42 to fit underneath the window frame in proper position, and then cut the plastic clip strip 53 to the proper size to fit the length of the edge of the short top side wall 42 and the adjacent short edges of the end walls 53 and 54. The weatherstripping material 54 may then be cut to size to fit the flanges 46 extending from the side walls 43, 44 and 45, the paper backing peeled off, and the weatherstripping material adhered to the flanges; similarly the weatherstripping material is cut to a size to fit the lengths of the connection strips 53 which are to be mounted onto the edges of the side walls 42, 43 and 45. The connection strips 53 with weatherstripping 54 are then emplaced in proper position, the cover is placed in its desired position covering the air conditioner, the retainers 22 are then placed in their desired position to engage the flanges 46, holes are drilled by the user at the desired position of the retainers 22, the wall holding clamps 23 are inserted in the holes, and the screws 24 are screwed in to mount the retainers on the wall. The cover is then placed back in proper position on the wall and the cantilevered portions of the retainers 22 are turned to engage the top surfaces of the flange 46 and hold the cover in position over the air conditioner.

It is apparent that the kit for a cover for an air conditioner mounted beneath a window may utilize a one piece cover body portion identical to that shown in FIGS. 1–3, wherein the one piece cover body includes the back panel 13, the side walls 14–15, and the flange 20 extending entirely around all of the side walls. The user may then simply cut off the flange along the top side wall 42 and whatever portion of the top side wall necessary to fit the cover body into proper position over the air conditioner and under the window frame. The kit would further include weatherstripping material and a length of plastic connection strip 53 which would be cut to size by the user to connect to the edges of the top and end side walls in the manner described above.

It is understood that the invention is not confined to the particular construction and arrangement of parts herein illustrated and described, but embraces such modified forms thereof as come within the scope of the following claims.

What is claimed is:

1. A cover for a wall mounted air conditioner which extends into the interior of the room from the wall in which it is mounted, comprising:

(a) a cover body having:

(1) a flat, rectangular back panel adapted in size to cover the face of the air conditioner;

(2) top, bottom and end side walls formed integrally with the back panel and extending inwardly therefrom toward the wall in which the air conditioner is mounted, the side walls being integrally connected together to form a continuous side wall about the back panel and flaring out at an angle therefrom;

(3) a flange formed integrally with and extending outwardly from the side walls in a plane substantially parallel to the back panel;

(4) a lip formed integrally with and curving inwardly from the outer edges of the flange for a short distance;

(5) a curved joint section parallel to the back panel which divides each of the top, bottom and end side walls into a first section adjacent to the back panel and a second section adjacent to the room wall, the joint section in each of the side walls curving outwardly from the first side wall section and then inwardly to meet the second side wall section such that the second side wall section is spaced outwardly from the first side wall section, each of the first side wall sections flaring outwardly from the back panel at a greater angle than the angle at which the second side wall section of each of the side walls flares outwardly from the back panel;

(b) a sealing strip of resilient, compressible weatherstripping material secured to the inner side of the flange around the entire periphery of the flange at a position adjacent to the lip on the flange; and (c) means for removably securing the cover body to the wall over the air conditioner so as to compress the sealing strips about the periphery of the cover body.

2. The cover of claim 1 wherein the back panel, side walls, flange, and lip are made of high impact polystyrene.

3. The cover of claim 1 wherein the first side wall section of each of the side walls flares outwardly from the back panel at an angle 5° from a perpendicular to the back panel, and wherein the second side wall section of each side wall flares outwardly from the back panel at an angle 2° from a perpendicular to the back panel.

4. The cover of claim 1 wherein the sealing strip is composed of open cell foamed plastic and is attached to the inner surface of the flange by pressure sensitive adhesive.

5. A cover for a wall mounted air conditioner which extends into the interior of the room from the wall, and which is mounted immediately underneath a window having a frame, comprising:

(a) a cover body having:

(1) a flat, rectangular back panel adapted in size to cover the face of the air conditioner;

(2) top, bottom, and end side walls formed integrally with the back panel and extending inwardly therefrom toward the wall in which the air conditioner is mounted, the side walls being integrally connected together to form a continuous side wall about the back panel and flaring out at an angle therefrom, the top panel terminating in an inner edge and being shorter than the bottom and end side walls to leave a gap sized and adapted to fit the frame of the window under which the air conditioner is mounted;

(3) a flange formed integrally with and extending outwardly from the bottom and end side walls in a plane substantially parallel to the back panel, the flange terminating at the top edges of the end side walls;

(4) a lip formed integrally with and curving inwardly from the outer edges of the flange for a short distance;

(b) a sealing strip of resilient, compressible weatherstripping material secured to the inner side of the flange at a position adjacent to the lip on the flange;

(c) clip connection strips having a pair of leg strips attached together and a shoulder generally perpendicular to the leg strips, a connection strip being mounted to the edge of the top side wall along the length thereof, and a pair of connection strips being mounted to the top edges of the end side walls along the lengths thereof;

(d) sealing strips of resilient, compressible weatherstripping material secured to the length of the clip connection strips on the top edges of the end side walls and the edge of the tope side wall to engage and seal against the window frame beneath which the air conditioner is mounted; and (e) means for engaging the outer surface of the flange and removably securing the cover body to the wall over the air conditioner so as to compress the sealing strips about the periphery of the cover body.

6. The cover of claim 5 wherein the means for engaging the flange and removable securing the cover body includes:

a plurality of retainers each having a base and a cantilevered portion extending therefrom which is adapted to engage the outer side of the flange, at least one retainer being positioned at the wall along at least two sides of the cover body adjacent the flange thereon, each retainer being formed such that the cantileverd portion can be turned to engage the outer surface of the adjacent flange and push the same inwardly toward the wall to compress the sealing strip between the flange and the wall; and means for rotatably attaching the retainers to the wall.

7. The cover of claim 5 including a curved joint section parallel to the back panel which divides each of the bottom and end side walls into a first section adjacent to the back panel and a second section adjacent to the room wall, the joint section in each of the side walls curving outwardly from the first side wall section and then inwardly to meet the second side wall section such that the second side wall section is spaced outwardly from the first side wall section, each of the first side wall sections flaring outwardly from the back panel at a greater angle than the angle at which the second side wall section of each of the side walls flares outwardly from the back panel.

8. The cover of claim 5 or 7 wherein the back panel, side walls, flange, and lip are made of high impact polystyrene.

9. The cover of claim 5 wherein the back panel is approximately 26 inches long by 18 inches wide and wherein the height of the bottom and end side walls, from the back panel to the flange, is approximately 4 inches, and wherein the flange extends outwardly from the side walls approximately ¾ inch.

10. The cover of claim 7 wherein the first side wall sections of each of the side walls flares outwardly from the back panel at an angle 5° from a perpendicular to the back panel, and wherein the second side wall section of each side wall flares outwardly from the back panel at an angle 2° from a perpendicular to the back panel.

11. The cover of claim 5 or 7 wherein the sealing strip is composed of open cell foamed plastic and is attached to the inner surface of the flange by pressure sensitive adhesive.

12. A kit for making a cover for a wall mounted air conditioner which extends into the interior of the room from the wall in which the air conditioner is mounted, the kit comprising the combination of:

(a) a cover body having:

(1) a flat, rectangular back panel adapted and sized to cover the face of the air conditioner;

(2) top, bottom, and end side walls formed integrally with the back panel and extending inwardly therefrom, the side walls being integrally connected together to form a continuous side wall about the back panel and flaring out at an angle therefrom;

(3) a flange formed integrally with and extending outwardly from the side walls in a plane substantially parallel to the back panel;

(4) a lip formed integrally with and curving inwardly from the outer edges of the flange for a short distance;

(b) a length of sealing strip of resilient, compressible weatherstripping material having a pressure sensitive adhesive on one surface thereof to adapt the weatherstripping material to be secured to the inner sides of the flanges just adjacent the lip on the flange;

(c) a plurality of retainers each having a base and a cantilevered portion extending therefrom which is adapted to engage the outer side of the flange, a sufficient number of the retainers being provided to mount at least one retainer to the wall along at least two sides of the cover body; and (d) a plurality of wall mounting clamps, equal in number to the retainers, and a plurality of screws for attaching the retainers to the wall mounting clamps; and (e) a clip connection strip having a pair of leg strips attached together and a shoulder generally perpendicular to the leg strips, the connection strip adapted to be cut to conform in length to fit over any portions of the top and end side walls which have the flange cut therefrom, the weatherstripping material adapted to be cut to conform in length to the connection strips and to be adhered to the connection strips in position to seal against the frame or sill of the window under which the air conditioner is mounted.

* * * * *